US005749498A

United States Patent [19]

Lavoie et al.

[11] Patent Number: 5,749,498

[45] Date of Patent: May 12, 1998

[54] APPLICATOR AND SPREADER TOOL FOR ADHESIVES

[76] Inventors: Pierre Lavoie, 8996 Lionel Giroux, St. Leonard, Quebec, Canada, HIR 3K9; Andre Lavoie, 1864 Albert, St. Hubert, Quebec, Canada, J4T 1V2; Denis Lavoie, 1504 Rocheleau, St. Anne de Sabrevoie, Quebec, Canada, J0G 2J0

[21] Appl. No.: 675,145

[22] Filed: Jul. 3, 1996

[51] Int. Cl.[6] ..... B67D 5/06

[52] U.S. Cl. ..... 222/192; 222/326; 222/533; 222/566; 239/587.5; 239/588

[58] Field of Search ..... 222/192, 326, 222/533, 566; 239/587.1, 587.5, 588

[56] References Cited

U.S. PATENT DOCUMENTS

| | | | |
|---|---|---|---|
| 3,393,844 | 7/1968 | Beres et al. | 222/533 |
| 3,501,063 | 3/1970 | Sundholm | 222/326 |
| 3,779,467 | 12/1973 | Arbon | 239/587.5 X |
| 3,908,910 | 9/1975 | Detwiler | 239/587.5 X |
| 3,940,072 | 2/1976 | Ishikawa et al. | 239/587.5 X |
| 4,213,546 | 7/1980 | Massey | 222/326 X |
| 4,390,115 | 6/1983 | Bigham | 222/326 |
| 4,570,834 | 2/1986 | Ward | 222/566 |

FOREIGN PATENT DOCUMENTS

| | | | |
|---|---|---|---|
| 8904796 | 6/1989 | WIPO | 222/192 |

*Primary Examiner*—Joseph Kaufman
*Attorney, Agent, or Firm*—Eric Fincham

[57] ABSTRACT

A tool for use with a cartridge gun adapted to dispense a product from a cartridge, the tool having first and second nozzle members with a fluid passageway extending therethrough, the first and second nozzle members being rotatably moveable such that they may be moved through 180° with respect to each other, the nozzle members having an arcuate configuration, and a guide member to guide the dispensing end of the tool through a prescribed path with respect to a fixed object. The tool permits a uniform dispensing at a desired distance and permits the user to dispense the contents into all corners of a room or the like.

16 Claims, 2 Drawing Sheets

APPLICATOR AND SPREADER TOOL FOR ADHESIVES

FIELD OF THE INVENTION

The present invention relates to an adhesive applicator and spreader and more particularly, relates to a tool suitable for use with a cartridge which in turn is used in a cartridge gun.

BACKGROUND OF THE INVENTION

The use of cartridges and cartridge guns is well known for dispensing a number of different materials. These cartridges may contain materials such as caulking, adhesives, coatings, etc. Their use is widespread and they are used both by the amateur and professional.

In practice, the cartridges usually comprise a cylindrical body of a paperboard or plastic material. At one end there is provided a nozzle through which the contents are dispensed. At the other end, an end piece is slideably displaceable such that when the cartridge is placed in a cartridge gun, the piston associated with the cartridge gun will exert pressure on the end piece and thereby force the contents to be dispensed through the nozzle.

Typically, a nozzle comprises an elongated plastic member which is cut or trimmed to a desired size and configuration by the user.

While these cartridges are suitable for dispensing a single ribbon or a bead of material, some applications require that the material be spread over a wider area. Accordingly, there are various adaptor tools which are known in the art and which are adapted to fit on the end of the nozzle to spread the material.

Frequently the material which must be spread is an adhesive type material and one particular common use of such a spreading tool is in the application of adhesives on a baseboard molding such as in commonly used in residences, office buildings and commercial establishments. At the present time, the person installing the molding will typically use such a spreader tool to apply a plurality of beads of adhesive to the back of the molding following which the molding is put in place against the wall adjacent the floor.

A problem which arises with the use of such a spreader tool is the even application of the adhesive on the molding. Thus, the beads when applied may not necessarily be straight particularly when there is a novice using the tool and/or when the person may be somewhat fatigued. In such an instance, the adhesive may be applied in such a manner that either the top or the bottom of the molding may not have the right amount of adhesive applied thereto and accordingly the molding would not be properly secured to the wall.

A further problem which arises with the use of the spreading tool is that after the adhesive is applied to the molding, it becomes somewhat difficult to apply the molding to the wall while the adhesive is thereon. Typically, moldings for commercial establishments and office buildings are of a vinyl material which is provided in a roll. The installer must first unroll the material, apply the adhesive, and then attempt to place the molding in the desired position.

SUMMARY OF THE INVENTION

It is an object of the present invention to provide a spreading tool which overcomes the above disadvantages.

It is a further object of the present invention to provide a spreading tool whereby adhesive may be placed on wall surface and wherein a plurality of beads are maintained in a substantially parallel relationship to the floor.

It is a further object of the present invention to provide a spreader tool for a cartridge gun and which spreader tool is easy to use and economical.

According to one aspect of the present invention, there is provided a tool suitable for use with a cartridge gun adapted to dispense a product from a cartridge, the tool comprising a first nozzle member, a second nozzle member, a fluid passageway extending between the first and second nozzle members, the first and second nozzle members being rotatably movable such that the position of the second nozzle member can be moved through 180° with respect to the first nozzle member, at least one of the first and second nozzle members having an arcuate configuration extending through at least 25°, the fluid passage way having an inlet end and a dispensing end, guide means associated with the tool to guide the dispensing end through a prescribed path with respect to a fixed object.

In greater detail, the spreader tool of the present invention is designed for use with cartridges and cartridge guns such as those which are well known in the art and widely used. Although the present invention specifically refers to adhesives and to the application for molding at the point of juncture between a floor and a wall, it will be understood that it also may be used in other applications.

For convenience sake, the tool of the present invention is preferably formed of a plastic material and to this end, may be injection molded from a suitable plastic material which would be resistant to the materials with which it is intended to be used.

As aforementioned, the tool includes first and second nozzle members which are rotatably mounted such that the position of the nozzle members can be changed through approximately 180°. By so doing, the ease of application in corners is enhanced.

There is provided a continuous conduit between the first and second nozzle members such that one has an inlet end to receive material from the cartridge and a dispensing end where the material is dispensed to the required application.

At the dispensing end of the tool, there is provided a fan-shaped arrangement of an appropriate width for the application of a plurality of beads of material.

According to the present invention, the conduit body is of an arcuate configuration to provide for ergonomical use of the tool. Thus, conventional spreader tools have a straight body and as such, are very difficult to use and are tiring for the user. Preferably, the present invention has a conduit body which has a curve of between 25° and 60° therein and more preferably between 40° and 50°. It has been found such a curved conduit body provides for ergonomical use of the tool.

At the dispensing end, there are preferably provided a plurality of teeth are provide to further spread the beads of adhesive in a desired manner. The teeth assist in ensuring an even application of the adhesive.

The dispenser tool will also include guide means which are adapted to keep the tool in a fixed spaced relationship from the floor. This ensures that the adhesive is applied in a manner so as to be substantially parallel to the floor.

In the preferred embodiment of the present invention, the tool includes means for rotating the dispensing end 180°. This is an important advantage since when one reaches a corner, it becomes very difficult to ensure the even application of the adhesive. With the capability of rotating through 180° one is able to apply the adhesive to the point of juncture of the walls.

BRIEF DESCRIPTION OF THE DRAWINGS

Having thus generally described the invention, reference will now be made to the accompanying drawings illustrating an embodiment thereof, in which.

DESCRIPTION OF PREFERRED EMBODIMENTS

Figure 1:
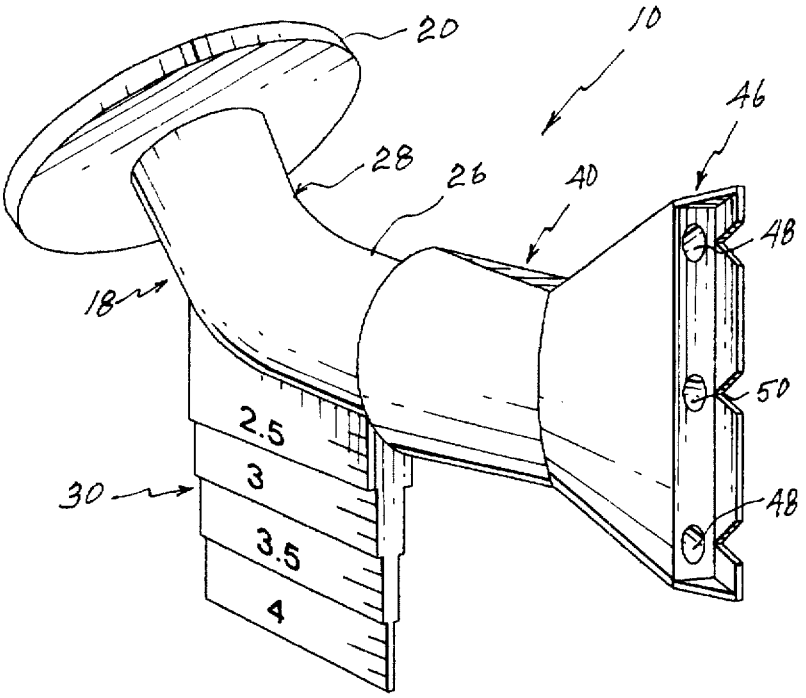
FIG. 1 is a perspective view of a tool according to the present invention.

Referring to the drawings in greater detail and by reference characters thereto, a tool according to the present invention is generally designated by reference numeral 10. Tool 10 is designed for use with a standard cartridge gun 12 which will include an end plate 14 having an aperture therein adapted to accommodate a dispensing nozzle 16 when the cartridge is placed therein.

Tool 10 includes a first nozzle member generally designated by reference numeral 18 and which nozzle member includes a base 20 having an aperture 22 formed therein. A plurality of bosses 24 extend outwardly from a rear face of base 20.

A cylindrical conduit section 26 is formed intricately with piece 20 and includes an elbow portion 28 such that the conduit 26 is angled.

Extending downwardly from conduit 26 is a guide member generally designated by reference numeral 30. Guide member 30 includes a plurality of breakaway sections 32, 34 and 36. Each of these sections may have suitable indicia thereon as shown in FIGS. 1 and 3.

Figure 3:
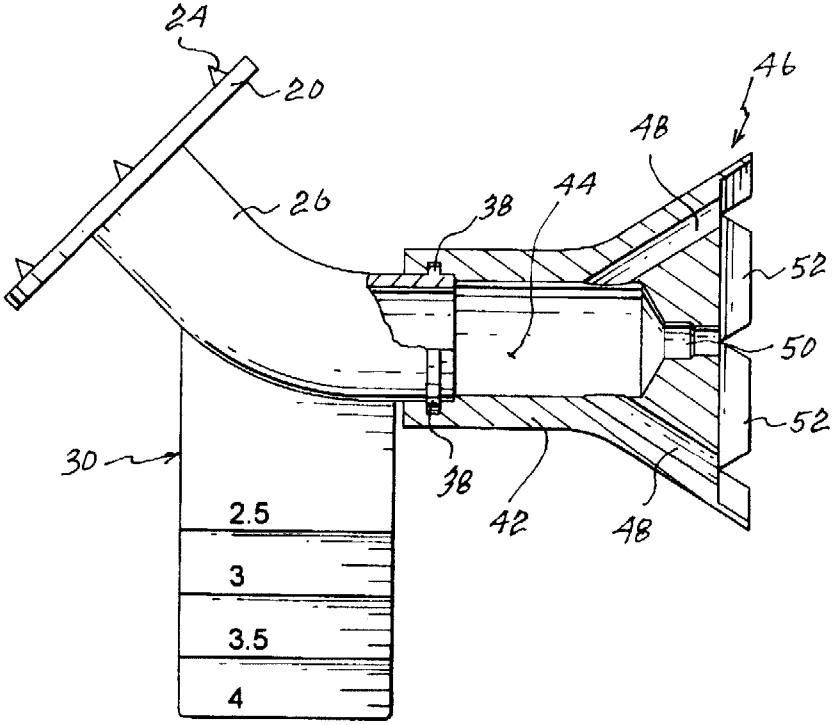
FIG. 3 is a side elevational view, partially in section, of the tool of FIG. 1.
Figure 4:
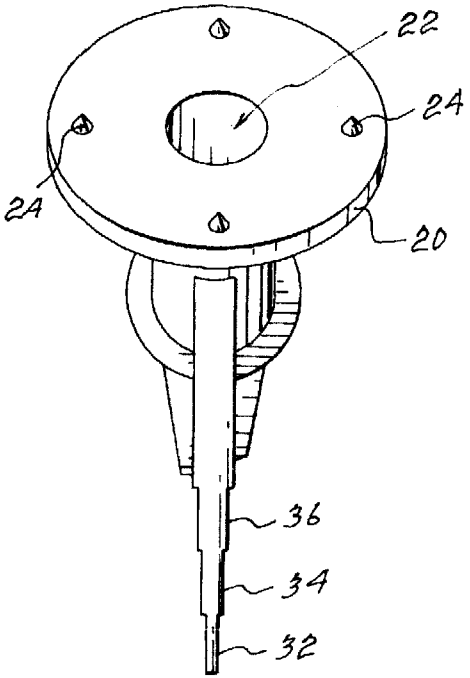
FIG. 4 is a rear elevational view thereof.

As may be seen in FIG. 3, conduit 26 has a pair of diametrically opposed, outwardly extending pins 38.

Tool 10 also includes a second nozzle member 40 having a conduit portion 42 with an interior cavity 44. Second nozzle member 40 also includes a fantail section generally designated by reference numeral 46. As may be seen from FIG. 3, fantail section 46 includes a pair of side passageways 48 which communicate between the exterior and cavity 44. There is also provided a center passageway 50. A plurality of spreading members 52 are located on one side about the outlet of passageways 48 and 50.

Again referring to FIG. 3, second nozzle member 40 interconnects with first nozzle member 18 by means of pins 38 which fit within an "L" shaped channel (not shown) within wall 42 of the second nozzle member 40.

Figure 2:
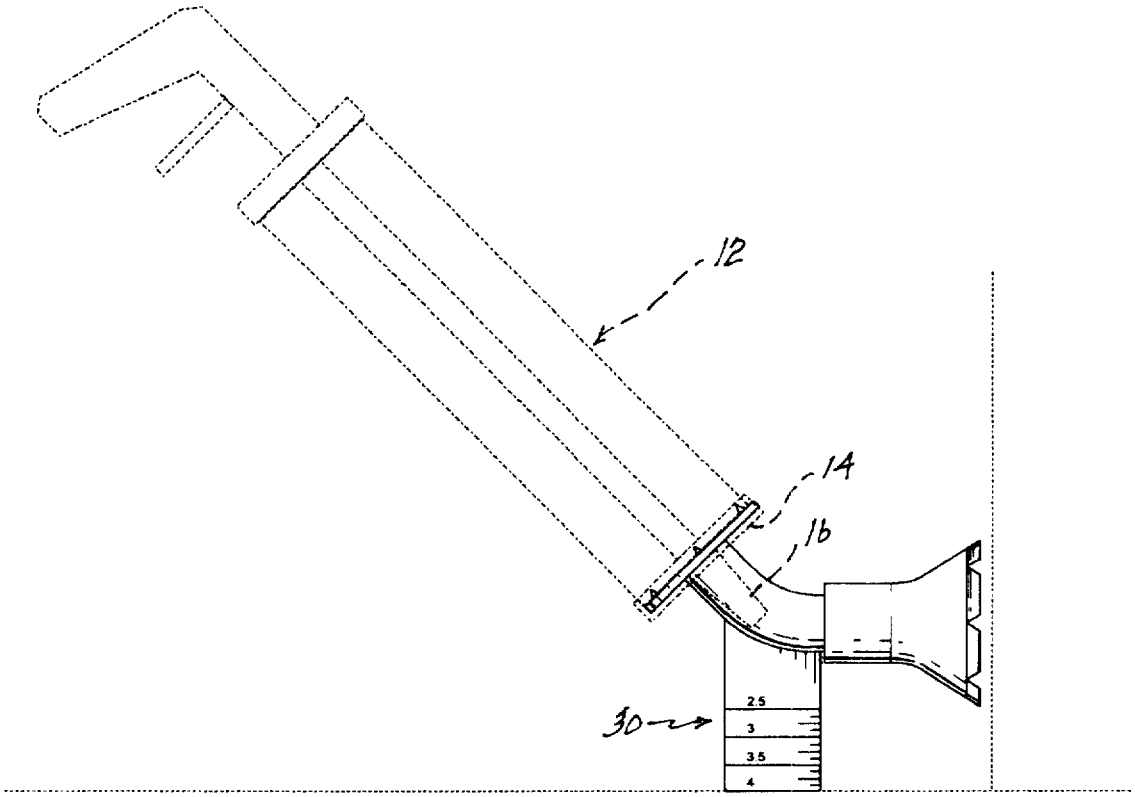
FIG. 2 is a side elevational view illustrating the use of a tool.
Figure 5:
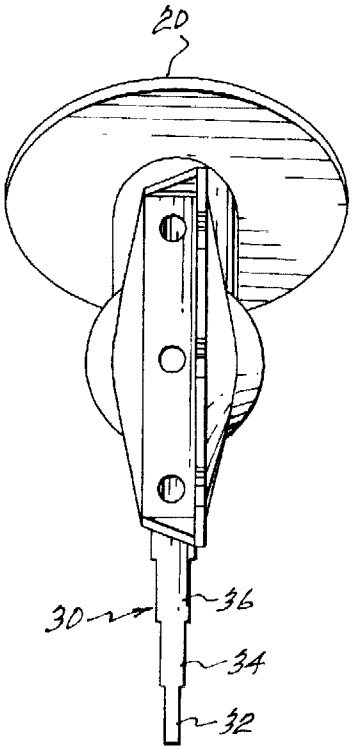
FIG. 5 is a front elevational view thereof.

As will be seen from the above, tool may be utilized whereby guide member 30 would be placed on a floor or other surface as shown in FIG. 2 to ensure that the adhesive or other material is dispensed at a uniform height from the floor. As will be understood, one may start at a corner; when arriving at the opposite corner (in the case of a U-shaped configuration) one frequently has a problem. With the ability to rotate through 180° one can restart the application at the opposed corner and provide for a uniform distribution of adhesive.

It will be understood that the above described embodiment is for purposes of illustration only and the changes and modifications may be made thereto without departing from the spirit and scope of the invention.

I claim:

1. A tool suitable for use with a cartridge gun adapted to dispense a product from a cartridge, the tool comprising a first nozzle member having an inlet end, a second nozzle member having a dispensing end, a fluid passageway extending between said inlet end and said dispensing end of said first and second nozzle members respectively, said first and second nozzle members being rotatably movable such that the position of said second nozzle member can be moved through 180° with respect to said first nozzle member, at least one of said first and second nozzle members having an arcuate configuration extending through between at least 25° and 60°, guide means associated with said tool to guide said dispensing end through a prescribed path spaced from a fixed object; wherein said guide means comprises a breakaway member.

2. The tool of claim one wherein said guide means comprises a member extending outwardly from one of said nozzle members to thereby space said one nozzle member from a surface.

3. The tool of claim 2 wherein said guide means are adjustable.

4. The tool of claim 1 wherein said first nozzle member includes a flange adjacent to said inlet end, said flange being adapted to seat against an end of said cartridge gun.

5. The tool of claim 4 further including means associated with said flange to prevent rotation between said flange and a cartridge placed in said gun.

6. The tool of claim 3 wherein said means comprises one or more prongs extending from said flange and adapted to engage said cartridge.

7. The tool of claim 1 wherein said first nozzle member has an arcuate section between said inlet end and an outlet end thereof extending through approximately 45°.

8. The tool of claim 7 wherein said guide means comprises a guide member extending outwardly from a portion of said first nozzle adjacent said outlet end thereof.

9. The tool of claim 1 wherein said first and second nozzle members are secured together by a pin and groove arrangement such that said second nozzle member can be removed from said first nozzle member and rotated through 180°.

10. The tool of claim 1 wherein said second nozzle member has a plurality of dispensing passages formed adjacent said dispensing end.

11. The tool of claim 10 further including spreader means at said dispensing end of said second nozzle.

12. In combination, a cartridge gun having a cartridge barrel and an end plate, a tool comprising a first nozzle member having an inlet end, a second nozzle member having a dispensing end, a fluid passageway extending between said inlet end and said dispensing end of said first and second nozzle members respectively, said first and second nozzle members being rotatably movable such that the position of said second nozzle member can be moved through 180° with respect to said first nozzle member, at least one of said first and second nozzle members having an arcuate configuration extending through between at least 25° and 60°, and a guide means associated with said tool to guide said dispensing end through a prescribed path with respect to a fixed object.

13. The combination of claim 12 wherein said guide means are adjustable.

14. The combination of claim 12 wherein said first nozzle member includes a flange adjacent to said inlet end, said flange being adapted to seat against said end plate of said cartridge gun.

15. The combination of claim 14 wherein said second nozzle member has a plurality of dispensing passages formed adjacent said dispensing end.

16. The combination of claim 15 further including spreader means at said dispensing end of said second nozzle member.

* * * * *